United States Patent [19]

Ward et al.

[11] 3,963,433

[45] June 15, 1976

[54] FORMATION OF URETHANE CROSSLINKS IN CELLULOSE ETHERS INCORPORATING AMINE GROUPS BY USE OF PROPYLENE OR ETHYLENE CARBONATE

[75] Inventors: Truman L. Ward; Ruth R. Benerito, both of New Orleans, La.

[73] Assignee: The United States of America as represented by the Secretary of Agriculture, Washington, D.C.

[22] Filed: July 23, 1975

[21] Appl. No.: 598,466

[52] U.S. Cl. ..... 8/120; 8/129; 8/DIG. 11

[51] Int. Cl.[2] ..... D06M 11/00; D06M 13/10

[58] Field of Search ..... 8/120, 129, DIG. 11

[56] References Cited

UNITED STATES PATENTS 3,617,197 11/1971 Ulrich ..... 8/116.3

*Primary Examiner*—John Kight, III

*Attorney, Agent, or Firm*—M. Howard Silverstein

[57] ABSTRACT

Partially Aminoethylated cotton fabric is reacted with either propylene carbonate (4-methyl 1,3 dioxol-2-one) or ethylene carbonate (1,3 dioxol-2-one) with potassium carbonate as catalyst. Reaction is carried out in a heated vacuum oven. The resultant product has urethane crosslinks and improved wrinkle recovery properties.

4 Claims, No Drawings

FORMATION OF URETHANE CROSSLINKS IN CELLULOSE ETHERS INCORPORATING AMINE GROUPS BY USE OF PROPYLENE OR ETHYLENE CARBONATE

This invention relates to chemical modification of cotton cellulose with heterocyclic carbonates to form urethane type grafts and crosslinks and improved wrinkle recovery properties. More specifically, this invention relates to the modification of cotton fabric which has been partially aminoethylated said modification being achieved by padding the fabric in either propylene carbonate (4-methyl 1,3 dioxol-2-one) or ethylene carbonate (1,3 dioxol-2-one) and curing the padded fabric in a heated exacuated oven. Potassium carbonate serves to catalyze the reaction. The product thus obtained has urethane type crosslinks and grafts as indicated by Infrared (IR) spectra and the wrinkle recovery properties are improved as measured by ASTM Specification D-1295-67, Philadelphia, Pa., 1967.

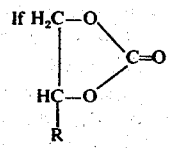

represents the cyclic carbonate where R is hydrogen in the case of ethylene carbonate and R is $CH_3$ in the case of propylene carbonate and if the reactive hydroxyl group of partially aminoethylated cotton is represented by CellOH and the aminoethyl group by Cell$OC_2H_4NH_2$, a schematic which would represent the pertinent reactions of this invention is as follows:

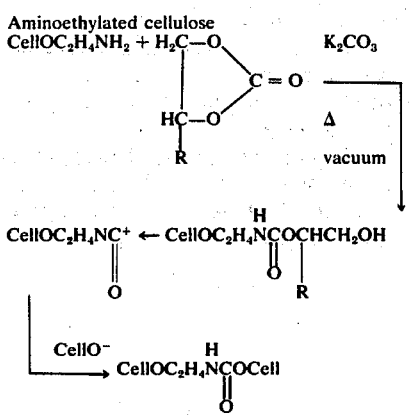

It is essential to the instant invention that the aminoethylated cellulose have replaceable hydrogen and that some unreacted hydroxyl sites remain in the aminoethylated cellulose.

The main object of this invention is to provide a process for adding urethane type crosslinks and grafts to cotton. A second object of this invention is to improve the wrinkle recovery properties of aminoethylated cotton fabrics.

The preparation of partially aminoethylated cotton is documented in chemical literature. The instant invention uses this as starting material.

The instant invention discloses a process wherein aminoethylated cotton sample is padded to add the cyclic carbonate and a catalyst. The padded fabric is then reacted under vacuum at temperatures of about 140° to 160°C. The resultant products have gained weight and IR spectra reveals the presence of urethane type bonds or groups,

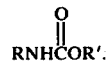

Increased wrinkle recovery and microscopical studies indicate that crosslinking has occurred. The instant invention requires that the amine groups have a replaceable hydrogen.

We have discovered that reaction between the cotton cellulose, which has been modified to contain amine groups with a replaceable hydrogen, and the heterocyclic carbonate can be caused to proceed by use of $K_2CO_3$ as a catalyst to open the heterocyclic carbonate ring, supplemented by use of heat and vacuum. We have further discovered that with a given amount of vacuum, the heat needs to be within specified limits to obtain reaction in a reasonable length of time without scorching or discoloring the fabric. The vacuum is also necessary to obtain the second part of a two step reaction to produce the crosslinks. In the first step the opened ring reacts with the amine group to yield the hydroxyethyl carbamate intermediate. This step may occur with or withour vacuum. The second step requiring vacuum has the hydroxyethyl carbamate losing glycol to leave a reactive residue which then reacts with a cellulosic hydroxyl on the fabric to yield the urethane type crosslink. The crosslinking produces the much improved wrinkle recovery.

By the process of this invention, the aminoethylated cotton fabric of degree of substitution of about 0.05 (D.S. about 0.05) is padded to 100% takeup with the heterocyclic carbonate containing about 2% potassium carbonate. The heterocyclic carbonate may be either propylene or ethylene carbonate or a mixture of the two. The padded fabric is placed in an oven preheated to about 140° to 160°C and the oven evacuated to a pressure of about 35 mm Hg. The vacuum and heat are maintained for a period of from about 1 to 3 hours. Temperatures above 160°C discolor the fabric. It should be evident to one skilled in the art that the higher temperature requires less reaction time. After the required reaction time is completed, the vacuum is released, the sample is removed and rinsed well with water to remove unreacted material.

The following examples illustrate the invention:

EXAMPLE 1

Partially aminoethylated cotton fabric (D.S. = 0.06) prepared from 80 × 80 thread count unmodified cotton printcloth was padded to 100% takeup by weight in propylene carbonate containing 2% potassium carbonate. The wet padded fabric was placed into a vacuum oven which had been preheated to 160°C. The oven was evacuated to 35 mm Hg. Temperature and vacuum were maintained for 60 minutes after which the vacuum was released, the fabric washed well with water to remove unreacted material and dried. Control samples of the fabric without any added reactant and of the fabric with propylene carbonate but without catalyst were included.

The resultant product was analyzed by Infrared spectroscopy and was found to contain the urethane type group

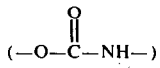

but no urea type group

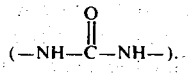

The weight gain was 1.8%. Conditioned wrinkle recovery had increased from 95 (W+F)° for the untreated aminoethylated cotton control to 168 (W+F)°. The sample treated without catalyst had a conditioned recovery of 98 (W+F)°. The wet wrinkle recovery had increased from 264 (W+F)° for the untreated control to 278 (W+F)°. Microscopical examination of fibers in the sample showed the solidified layer characteristic of crosslinked cellulosic fibers.

EXAMPLE 2

The fabric and technique of Example 1 were employed except that atmospheric pressure was used rather than vacuum. The resultant fabric product did not show urethane bonds in IR spectra. The conditioned wrinkle recovery was only 102 (W+F)° and the wet wrinkle recovery 260 (W+F)°. This clearly shows that the reaction does not proceed at atmospheric pressure.

EXAMPLE 3

The fabric and technique of Example 1 were used, except that 140°C was the temperature rather than 160°C. The resultant fabric products showed urethane bonds in the IR spectrum. A conditioned wrinkle recovery of 170 (W+F)° could be obtained in 180 minutes at this temperature as compared to 60 minutes at 160°C in Example 1. The wet wrinkle recovery was 281 (W+F)°. It takes 3 times as long at 140°C to achieve the same amount of result as at 160°C.

EXAMPLE 4

The fabric and technique of Example 1 in a series of samples were used except with the length of reaction time varying from 30 minutes to 120 minutes. At 30 minutes a conditioned wrinkle recovery of 125 (W+F)° was obtained while at 120 minutes the conditioned recovery had risen to 180 (W+F)°. Wet recovery for all samples was in the range of 266 to 275 (W+F)°. All samples had urethane crosslinks.

EXAMPLE 5

The fabric and technique of Example 1 were employed except ethylene carbonate was substituted for propylene carbonate. The resultant fabric had the same properties as the product of Example 1.

EXAMPLE 6

The fabric and technique of Example 1 were employed except a mixture of equal parts (by weight) of ethylene and propylene carbonate were used rather than propylene carbonate. The resultant fabric had the same properties as the product of Example 1.

We claim:

1. A process for imparting high conditioned (dry) and high wet wrinkle recovery to partially aminoethylated cotton fabric, the process comprising:

a. impregnating a cotton fabric which has been aminoethylated to a degree of substitution of about 0.05 with a heterocyclic carbonate selected from the group consisting of ethylene carbonate, propylene carbonate, and a mixture of ethylene and propylene carbonate and about 2% of potassium carbonate to a pickup of about 100%, b. placing the wet, impregnated fabric in a vacuum oven preheated to a temperature of about from 140° to 160°C, c. evacuating the oven to obtain a pressure of about 35 mm of mercury, d. maintaining the temperature and vacuum for about from 30 to 180 minutes to obtain reaction wherein urethane-type crosslinks are attained, and e. releasing the vacuum and washing the reacted fabric to remove all unreacted material.

2. The process of claim 1 wherein the heterocyclic carbonate is ethylene carbonate.

3. The process of claim 1 wherein the heterocyclic carbonate is propylene carbonate.

4. The process of claim 1 wherein the heterocyclic carbonate is a mixture of ethylene and propylene carbonate.

* * * * *